US008528360B2

(12) United States Patent
Betting et al.

(10) Patent No.: US 8,528,360 B2
(45) Date of Patent: Sep. 10, 2013

(54) METHOD AND SYSTEM FOR COOLING A NATURAL GAS STREAM AND SEPARATING THE COOLED STREAM INTO VARIOUS FRACTIONS

(75) Inventors: Marco Betting, Rijswijk (NL); Jacob Michiel Brouwer, Rijswijk (NL); Pascal van Eck, Rijswijk (NL); Cornelis Antonie Tjeenk Willink, Rijswijk (NL)

(73) Assignee: Twister B.V. (NL)

( * ) Notice: Subject to any disclaimer, the term of this patent is extended or adjusted under 35 U.S.C. 154(b) by 812 days.

(21) Appl. No.: 11/884,910

(22) PCT Filed: Feb. 24, 2006

(86) PCT No.: PCT/EP2006/060260

§ 371 (c)(1),
(2), (4) Date: Sep. 16, 2008

(87) PCT Pub. No.: WO2006/089948

PCT Pub. Date: Aug. 31, 2006

(65) Prior Publication Data

US 2009/0031756 A1 Feb. 5, 2009

(30) Foreign Application Priority Data

Feb. 24, 2005 (EP) ..... 05101420

(51) Int. Cl.
*F25B 9/02* (2006.01)
*F25J 3/00* (2006.01)

(52) U.S. Cl.
USPC ..... 62/619; 62/5; 62/620

(58) Field of Classification Search
USPC ..... 62/5, 116, 500, 620, 621, 910, 637; 95/149, 243, 29, 32, 34, 259; 96/389; 55/315, 55/343, 417, 459.1
See application file for complete search history.

(56) References Cited

U.S. PATENT DOCUMENTS

| | | | | |
|---|---|---|---|---|
| 2,289,329 | A * | 7/1942 | Prickett | 208/159 |
| 3,296,807 | A | 1/1967 | Fekete | 62/5 |
| 3,405,803 | A * | 10/1968 | Bahr et al. | 209/732 |
| 3,775,988 | A | 12/1973 | Fekete et al. | 62/23 |
| 4,061,481 | A | 12/1977 | Campbell et al. | 62/29 |
| 4,140,504 | A * | 2/1979 | Campbell et al. | 62/621 |
| 4,157,904 | A | 6/1979 | Campbell et al. | 62/27 |

(Continued)

FOREIGN PATENT DOCUMENTS

| | | |
|---|---|---|
| EP | 182643 | 5/1986 |
| EP | 1017465 | 7/2000 |

(Continued)

*Primary Examiner* — Allen Flanigan
*Assistant Examiner* — Jason Thompson
(74) *Attorney, Agent, or Firm* — Fliesler Meyer LLP

(57) ABSTRACT

A method for cooling a natural gas stream ($C_xH_y$) and separating the cooled gas stream into various fractions having different boiling points, such as methane, ethane, propane, butane and condensates, comprises: cooling the gas stream (1,2); and separating the cooled gas stream in an inlet separation tank (4); a fractionating column (7) in which a methane lean rich fluid fraction ($CH_4$) is separated from a methane lean fluid fraction ($C_2$+$H_z$); feeding at least part of the methane enriched fluid fraction from the inlet separation tank (4) into a cyclonic expansion and separation device (8), which preferably has an isentropic efficiency of expansion of at least 80%, such as a supersonic or transonic cyclone; and feeding the methane depleted fluid fraction from the cyclonic expansion and separation device (8) into the fractionating column (7) for further separation.

12 Claims, 2 Drawing Sheets

(56) References Cited

U.S. PATENT DOCUMENTS

| | | | | | |
|---|---|---|---|---|---|
| 4,171,964 | A | * | 10/1979 | Campbell et al. | 62/621 |
| 4,185,977 | A | | 1/1980 | Shirokov et al. | 62/23 |
| 4,278,457 | A | | 7/1981 | Campbell et al. | 62/24 |
| 4,629,555 | A | * | 12/1986 | Colman et al. | 209/721 |
| 4,859,347 | A | * | 8/1989 | Simon et al. | 210/788 |
| 5,246,575 | A | * | 9/1993 | Alexander | 210/188 |
| 5,275,005 | A | * | 1/1994 | Campbell et al. | 62/621 |
| 5,394,686 | A | * | 3/1995 | Child et al. | 60/780 |
| 5,561,982 | A | * | 10/1996 | Tunkel et al. | 62/5 |
| 5,615,561 | A | | 4/1997 | Houshmand et al. | 62/611 |
| 6,453,698 | B2 | * | 9/2002 | Jain et al. | 62/621 |
| 6,524,368 | B2 | | 2/2003 | Betting et al. | 95/29 |
| 6,540,917 | B1 | * | 4/2003 | Rachels et al. | 210/512.1 |
| 6,776,825 | B2 | * | 8/2004 | Betting et al. | 96/389 |
| 6,962,199 | B1 | * | 11/2005 | Tjeenk Willink | 166/265 |
| 2002/0189443 | A1 | | 12/2002 | McGuire | 95/32 |
| 2003/0136146 | A1 | * | 7/2003 | Fischer-Calderon et al. | 62/613 |
| 2004/0261452 | A1 | * | 12/2004 | Mak et al. | 62/620 |
| 2005/0045033 | A1 | * | 3/2005 | Nicol et al. | 95/269 |
| 2006/0283207 | A1 | * | 12/2006 | Pitman et al. | 62/620 |
| 2007/0227186 | A1 | * | 10/2007 | Alferov et al. | 62/620 |

FOREIGN PATENT DOCUMENTS

| | | |
|---|---|---|
| WO | WO03029739 | 4/2003 |
| WO | WO2004001260 | 12/2003 |
| WO | WO2004083691 | 9/2004 |

* cited by examiner

METHOD AND SYSTEM FOR COOLING A NATURAL GAS STREAM AND SEPARATING THE COOLED STREAM INTO VARIOUS FRACTIONS

PRIORITY CLAIM

The present application claims priority from European Patent Application 05101420.7 filed 24 Feb. 2005.

FIELD OF THE INVENTION

The invention relates to a method and system for cooling a natural gas stream and separating the cooled gas stream into various fractions, such as methane, ethane, propane, butane and condensates.

BACKGROUND OF THE INVENTION

In the oil & gas industry natural gas is produced, processed and transported to its end-users.

Gas processing may include the liquefaction of at least part of the natural gas stream. If a natural gas stream is liquefied then a range of so called Natural Gas Liquids (NGL's) is obtained, comprising Liquefied Natural Gas or LNG (which predominantly comprises methane or ($C_1$ or $CH_4$), Ethane ($C_2$), Liquefied Petrol Gas or LPG (which predominantly comprises propane and butane or $C_3$ and $C_4$) and Condensate (which predominantly comprise $C_5$+ fractions).

If the gas is produced and transported to regional customers via a pipe-line (grid), the heating value of the gas is limited to specifications. For the richer gas streams this requires mid-stream processing to recover $C_2$+ liquids, which are sold as residual products.

If regional gas production outweighs regional gas consumption, expensive gas transmission grids cannot be justified, hence the gas may be liquefied to LNG, which can be shipped as bulk. In producing $C_1$ liquids, $C_2$+ liquids are produced concurrently and sold as by-products.

Traditional NGL recovery plants are based on cryogenic cooling processes as to condense the light ends in the gas stream. These cooling processes comprise: Mechanical Refrigeration (MR), Joule Thompson (JT) expansion and Turbo expanders (TE), or a combination (e.g. MR-JT). These NGL recovery processes have been optimised over decades with respect to specific compression duty (i.e. MW/tonne NGL/hr). These optimisations often include: 1) smart exchange of heat between different process streams, 2) different feed trays in the fractionation column and 3) lean oil rectification (i.e. column reflux).

Most sensitive to the specific compression duty is the actual operating pressure of the fractionation column. The higher the operating pressure the lower the specific compression duty, but also the lower the relative volatility between the components of fractionation (e.g. $C_1$-$C_2$+ for a de-methanizer, $C_2$--$C_3$+ for a de-ethanizer etc.), which results in more trays hence larger column and/or less purity in the overhead stream.

European patent 0182643 and U.S. Pat. Nos. 4,061,481; 4,140,504; 4,157,904; 4,171,964 and 4,278,457 issued to Ortloff Corporation disclose various methods for processing natural gas streams wherein the gas stream is cooled and separated into various fractions, such as methane, ethane, propane, butane and condensates.

A disadvantage of the known cooling and separation methods is that they comprise bulky and expensive cooling and refrigeration devices, which have a high energy consumption.

These known methods are either based on isenthalpic cooling methods (i.e. Joule Thompson cooling, mechanical refrigeration) or near isentropic cooling methods (i.e. turbo-expander, cyclonic expansion and separation devices). The near isentropic methods are most energy efficient though normally most expensive when turbo expanders are used. However, cyclonic expansion and separation devices are more cost effective while maintaining a high-energy efficiency, albeit less efficient than a turbo expander device. Using a cost effective cyclonic expansion and separation devices, in combination with an isenthalpic cooling cycle (e.g. external refrigeration cycle) can restore the maximum obtainable energy efficiency.

It is therefore an object of the present invention to provide a method and system for cooling and separating a natural gas stream, which is more energy efficient, less bulky and cheaper than the known methods.

SUMMARY OF THE INVENTION

In accordance with the invention there is provided a method for cooling a natural gas stream and separating the cooled gas stream into various fractions having different boiling points, such as methane, ethane, propane, butane and condensates, the method comprising:

- cooling the gas stream in at least one heat exchanger assembly;
- separating the cooled gas stream in an inlet separation tank into a methane enriched fluid fraction and a methane depleted fluid fraction;
- feeding the methane depleted fluid fraction from the inlet separation tank into a fractionating column in which a methane rich fluid fraction is separated from a methane lean fluid fraction;
- feeding at least part of the methane enriched fluid fraction from the inlet separation tank into a cyclonic expansion and separation device in which said fluid fraction is expanded and thereby further cooled and separated into a methane rich substantially gaseous fluid fraction and a methane depleted substantially liquid fluid fraction, and
- feeding the methane depleted fluid fraction from the cyclonic expansion and separation device into the fractionating column for further separation,
- wherein the cyclonic expansion and separation device comprises:

a) an assembly of swirl imparting vanes for imposing a swirling motion on the methane enriched fluid fraction, which vanes are arranged upstream of a nozzle in which the methane enriched fluid fraction is accelerated and expanded thereby further cooled such that centrifugal forces separate the swirling fluid stream into a methane rich fluid fraction and a methane depleted fluid fraction, or b) a throttling valve, having an outlet section which is provided with swirl imparting means that impose a swirling motion to the fluid stream flowing through the fluid outlet channel thereby inducing liquid droplets to swirl towards the outer periphery of the fluid outlet channel and to coalesce.

The natural gas stream may be cooled in a heat exchanger assembly comprising a first heat exchanger and a refrigerator such that the methane enriched fluid fraction supplied to an inlet of the cyclonic expansion and separation device has a temperature between −20 and −60 degrees Celsius, and the cooled methane rich fraction discharged by the cyclonic expansion and separation device is induced to pass through the first heat exchanger to cool the gas stream.

The heat exchanger assembly may further comprises a second heat exchanger in which the cooled natural gas stream discharged by the first heat exchanger is further cooled before feeding the natural gas stream to the refrigerator, and that cold fluid from a bottom section of the fractionating column is supplied to the second heat exchanger for cooling the natural gas stream within the second heat exchanger.

In some embodiments a cyclonic expansion and separation device is used which is manufactured by the company Twister B.V. and sold under the trademark "Twister". Various embodiments of this cyclonic expansion and separation device are disclosed in International patent application WO 03029739, European patent 1017465 and U.S. Pat. Nos. 6,524,368 and 6,776,825. The cooling inside the cyclonic expansion and separation device apparatus may be established by accelerating the feed stream within the nozzle to transonic or supersonic velocity. At transonic or supersonic condition the pressure will drop to typically a factor ⅓of the feed pressure, meanwhile the temperature will drop to typically a factor ¾with respect to the feed temperature. The ratio of T-drop per unit P-drop for a given feed composition is determined with the isentropic efficiency of the expansion, which would be at least 80%. The isentropic efficiency expresses the frictional and heat losses occurring inside the cyclonic expansion and separation device.

These and other embodiments, features and advantages of the method and system according to the invention are disclosed in the accompanying drawings and are described in the accompanying claims, abstract and following detailed description of preferred embodiments of the method and system according to the invention in which reference is made to the accompanying drawings.

DETAILED DESCRIPTION OF A PREFERRED EMBODIMENT

Figure 1:
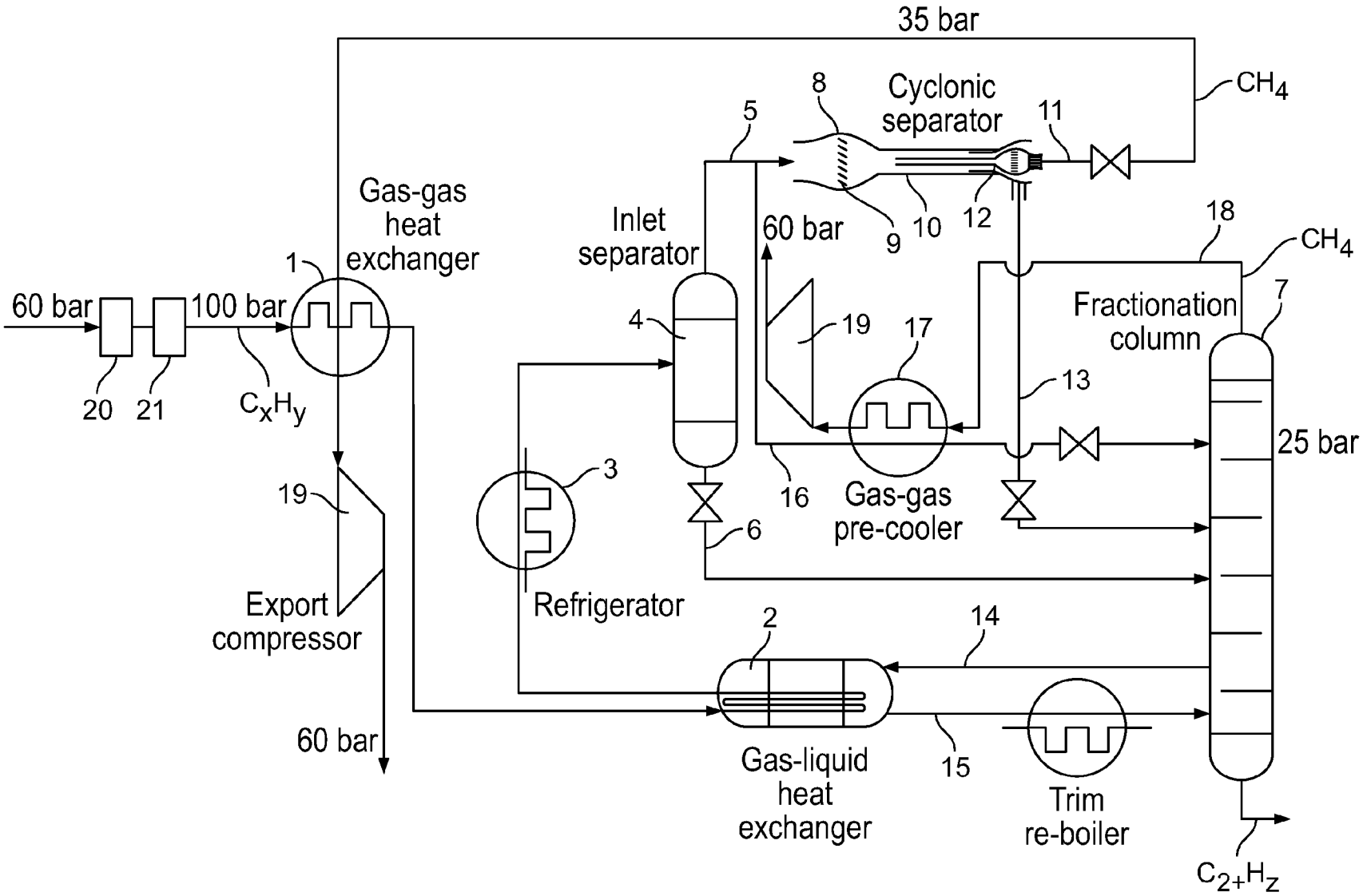
FIG. 1 is a flow scheme of a method and system for cooling and fractionating a natural gas stream in accordance with the invention.

FIG. 1 illustrates a flow scheme of a method and system according to the invention for cooling and fractionating a natural gas stream.

A natural gas stream $C_xH_y$ is compressed from about 60 bar to more than 100 bar in a feed compressor 20 and initially cooled in an air cooler 21 such that the natural gas stream has a pressure of about 100 bar when it enters a first gas-gas heat exchanger 1. The natural gas stream is subsequently cooled in a second heat exchanger 2 and thereafter in a refrigerator 3. The cooled natural gas stream discharged by the second heat exchanger 2 is separated in an inlet separator 4 into a methane enriched fraction 5 and a methane depleted fraction 6.

The methane depleted fraction 6 is fed into a fractionating column 7, whereas the methane enriched fraction 5 is fed into a cyclonic expansion and separation device 8.

The cyclonic expansion and separation device 8 comprises swirl imparting vanes 9, a nozzle 10 in which the swirling fluid mixture is accelerated to a transonic or supersonic velocity, a central primary fluid outlet 11 for discharging a methane rich fluid fraction $CH_4$ from the separator 8 and an outer secondary fluid outlet for discharging a condensables enriched & methane lean secondary fluid fraction into a conduit 13. The secondary fluid fraction is fed via conduit 13 into the fractionating column 7.

The first heat exchanger 1 is a gas-gas heat exchanger where the natural gas stream $CH_4$ is cooled with the lean primary gas stream $CH_4$ discharged from the central primary outlet 11 of the cyclonic expansion and separation device 8. The pre-cooled feed stream discharged by the first heat exchanger 1 is further cooled in the second heat exchanger 2, which may be a gas-liquid heat exchanger which is cooled by feeding it with liquids of one or more of the bottom trays of the fractionation column 7 as illustrated by arrows 14 and 15. The pre-cooled natural gas feed stream is then super-cooled in the refrigerator 3, which is driven by a cooling machine (either a mechanical refrigerator or absorption cooling machine).

The liquids formed during this 3-stage pre-cooling route are separated from a still gaseous methane enriched fraction in the inlet separator 4, and fed to one of the lower trays in the fractionating column 7 since it contains all heavy ends present in the feed (i.e. $C_4$+).

The gas coming over the top of said inlet separator is lean with respect to the heavier hydrocarbons (e.g. contains mostly $C_4$−). The deep NGL extraction (e.g. $C_2$-$C_4$) is done in the cyclonic expansion and separation device 8, where the gas is expanded nearly isentropically. Inside the cyclonic expansion and separation device 8 the temperature drops further to cryogenic conditions where nearly all $C_2$+ components are liquefied and separated. With the cryogenic separation inside the cyclonic expansion and separation device 8 $C_1$ gas slips along with the $C_2$+ liquids. A certain mole fraction of $C_1$ will dissolve in the $C_2$+ liquids. This $C_2$+ rich stream is fed to the fractionation column 7 where a sharp cut between light and heavy ends is established e.g. $C_1$-$C_2$+ (demethanizer), $C_2$−-$C_3$+ (de-ethanizer) etc.

In order to establish a pure top product from the fractionation column 7, a lean liquid reflux is created to absorb the lightest component which ought to leave the bottom of the column (e.g. $C_2$ for a de-methanizer). Said reflux stream is created by taking a side stream 16 from the cyclonic expansion and separation device 8 feed whilst subsequently cooling this side stream in a gas-gas pre cooler 17 with the overhead gas stream 18 (i.e. top product $CH_4$) of the fractionating column 7 and isenthalpically expanding the pre-cooled side stream 16 to the column pressure. During this isenthalpic expansion almost all hydrocarbons do liquefy and are fed as reflux to the top tray of the fractionating column 7. The $C_1$ gas flows produced from: 1) the primary fluid outlet 11 cyclonic expansion and separation device 8 (typically 80% primary flow) and. 2) the top outlet conduit 18 of the fractionating column 7 (typically 20% secondary flow), are compressed separately in export compressors 19 to an export pressure of about 60 bar. In the example shown the export pressure is about equal to the feed pressure of the natural gas stream $CH_4$ at the inlet of the first heat exchanger 1. Export compressor 19 therefore compensates the frictional and heat losses occurring in the cyclonic expansion and separation device 8. These losses are higher if the expansion in the cyclonic expansion and separation device 8 is deeper, hence the export compressor duties are proportionally higher. The mechanical duty of the refrigerator 3 is mainly proportional with the difference between the high condenser temperature ($T_{cond}$) and the low evaporator temperature ($T_{evap}$). If $T_0$ denotes ambient temperature then: $T_{cond}>T_0>T_{evap}$. In general this leads to the expression of the Carnot efficiency or the theoretical maximum cooling duty per unit mechanical duty of the refrigerator 3:

$$C.O.P_{Carnot} = \frac{\dot{Q}_{cooling}}{\dot{W}_{refrig}} = \frac{T_{evap}}{T_{cond} - T_{evap}}$$

For a propane refrigerator cycle with $T_{evap}$=−30° C. and $T_{cond}$=40° C., the Carnot C.O.P equals 3.5. In a real cooling machine, losses will diminish the C.O.P such that: C.O. Pactual ≈2.5. So for each MW compressor duty, 2.5 MW cooling duty can be obtained.

For a feed stream of 10 kg/s and a specific heat of 2.5 kJ/kg.K, one degree cooling requires 25 kW/K cooling duty. Hence, a cooling from −20° C.→−30° C. would require a cooling duty of 250 kW. For a evaporator temperature of −30° C. this corresponds with a mechanical duty of the refrigerator of 100 kW. If said additional cooling of 10° C. would be established through extra expansion in a cyclonic expansion and separation device, the expansion ratio ($P/P_{feed}$) needs to decrease from default 0.3→0.25 (i.e. deeper expansion). This results in a larger pressure loss over the cyclonic expansion and separation device 8, hence an additional export compressor duty of approx. 200 kW.

If the evaporator temperature of the refrigerator 3 is chosen in the cryogenic range, comparable to NGL reflux temperatures, i.e. $T_{evap}$=−70° C., the $C.O.P._{actual}$ of the cooling machine drops to ≈1.3. As a consequence a cooling from −60° C.→−70° C. still requires 250 kW cooling duty, though this corresponds with an mechanical duty of the refrigerator of 192 kW. If this additional cooling would be obtained in the cyclonic expansion and separation device 8 then the expansion ratio still decreases from 0.3→0.25, though the extra required compressor duty is reduced from 200 kW to 170 kW. This is mainly explained by the fact that the duty of any compressor is less at lower suction temperature, hence also the additional duty.

Concluding from the above: For the temperature trajectory −20° C.→−30° C. it is more efficient to get additional cooling from the refrigerator 3 than from a deeper expansion in the cyclonic expansion and separation device 8. The opposite holds for the temperature trajectory −60° C.→−70° C. as the COP of the cooling machine of the refrigerator 3 drops progressively with lower temperatures, requiring more refrigerator duty. As a consequence, for the combined cyclonic expansion and separation device-refrigerator cycle 3,8 an optimum can be found for the cooling duty per unit mechanical duty by making a distinct division of the mechanical duties between 1) the feed compressor 20 and 2) the compressor of the cooling machine of the refrigerator 3.

The cooling inside the cyclonic expansion and separation device 8 may be established by accelerating the feed stream within the nozzle 10 to transonic or supersonic velocity. At transonic or supersonic condition the pressure has dropped to typically a factor ⅓ of the feed pressure, meanwhile the temperature drops to typically a factor ¾ with respect to the feed temperature. The ratio of T-drop per unit P-drop for a given feed composition is determined with the isentropic efficiency of the expansion, which would be ≧80%. The isentropic efficiency expresses the frictional and heat losses occurring inside the cyclonic expansion and separation device.

At the expanded state inside the cyclonic expansion and separation device 8, the majority of the $C_2$+ components are liquefied in a fine droplet dispersion and separated via the outer secondary fluid outlet 12. The expansion ratio ($P/P_{feed}$) is chosen such that at least the specified $C_xH_y$ recovery is condensed into liquid inside the nozzle 10. Beyond the nozzle 10 in which the fluid stream is accelerated and thereby expanded and cooled the flow inside the cyclonic expansion and separation device 8 is split into a liquid enriched $C_2$+ flow (approx. 20 mass %) and a liquid lean $C_1$ flow (approx. 80% mass %).

The $C_1$ main flow is decelerated in a diffuser within the central fluid outlet 11, resulting in a rise of pressure and temperature. The P-rise and the accompanied T-rise in the diffuser is determined with both the isentropic efficiency of the expansion and the isentropic efficiency of the recompression. The isentropic efficiency of expansion, determines the remaining kinetic energy at the entrance of the diffuser, whereas the isentropic efficiency of recompression is determined with the losses inside the diffuser embodiment. The isentropic efficiency of recompression for the cyclonic expansion and separation device is approximately 85%. The resulting outlet pressure of the $C_1$ main flow is therefore lower than the feed pressure though higher than the outlet pressure of the $C_2$+ wet flow, which equals the fractionating column operating pressure.

As a result of the recompression, the temperature of the $C_1$ main flow is higher than the temperature in the top of the fractionation column. Hence, the potential duty of this $C_1$ main flow to pre-cool the feed is limited. The latter is an inherent limitation of a transonic or supersonic cyclonic expansion and separation device. The inherent efficiency of the cyclonic expansion and separation device is that it produces a concentrated super-cooled $C_2$+ wet flow feeding the fractionating column. Both the reduced flow rate feeding the fractionating column and the relatively low temperature enables the separation process in the column. For an LPG scheme comprising a cyclonic expansion and separation device the optimisation of the $C_2$+ recovery is found in creating a deeper expansion in the cyclonic expansion and separation device (i.e decrease of the ratio $P/P_{feed}$) and/or in the reduction of slip gas flow which comes along with the $C_2$+ wet flow. Both measures will result in an increase of the pressure loss, which needs to be compressed to export pressure.

It is preferred that from thermodynamic simulations an optimum for the $C_2$+ yield/MW compressor duty, is assessed for a certain duty of the refrigeration compressor versus the duty of the export compressor to compensate for the pressure loss in the cyclonic expansion and separation device. Said combined cycle compensates for the deficiency of limited pre-cooling. The evaporator of the refrigeration cycle may be connected to the inlet of cyclonic expansion and separation device 8 as to supercool the feed stream.

FIG. 2A-2D depict a Joule Thomson (JT) or other throttling valve, which is equipped with fluid swirling means which may be used as an alternative to the cyclonic expansion and separation device 8 depicted in FIG. 1.

The JT throttling valve shown in FIG. 2A-2D has a valve geometry that enhances the coalescence process of droplets formed during the expansion along the flow path of a Joule-Thomson or other throttling valve. These larger droplets are better separable than would be the case in traditional Joule- Thomson or other throttling valves. For tray columns this reduces the entrainment of liquid to the upper trays and hence improves the tray-efficiency.

Figure 2A:
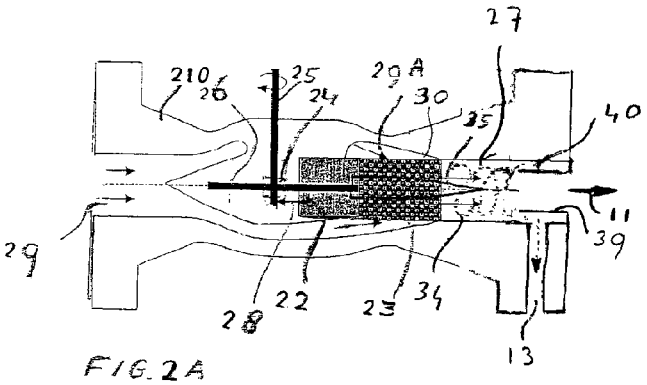
FIG. 2A depicts a longitudinal sectional view of a cyclonic expansion and separation device provided by a JT throttling valve, which is equipped with fluid swirling means.

The valve shown in FIG.2A comprises a valve housing 210 in which a piston-type valve body 22 and associated perforated sleeve 23 are slideably arranged such that by rotation of a gear wheel 24 at a valve shaft 25 a teethed piston rod 26 pushes the piston type valve body up and down into a fluid outlet channel 27 as illustrated by arrow 28. The valve has an fluid inlet channel 29 which has an annular downstream section 29A that may surround the piston 22 and/or perforated sleeve 23 and the flux of fluid which is permitted to flow from the fluid inlet channel 29 into the fluid outlet channel 27 is controlled by the axial position of the piston-type valve body 22 and associated perforated sleeve 23. The perforated sleeve 23 comprises tilted, non-radial perforations 30 which induce the fluid to flow in a swirling motion within the fluid outlet channel 37 as illustrated by arrow 34. A bullet-shaped vortex guiding body 35 is secured to the piston-type valve body 22 and arranged co-axially to a central axis 31 within the interior of the perforated sleeve 3 and of the fluid outlet channel 27 to enhance and control the swirling motion 34 of the fluid stream in the outlet channel 27.

The fluid outlet channel 27 comprises a tubular flow divider 39 which separates a primary fluid outlet conduit 11 for transporting a methane enriched fraction back to the first heat exchanger 1 shown in FIG. 1 from an annular secondary fluid outlet 40 for transporting a methane depleted fraction via conduit 13 to the fractionating column 7 shown in FIG. 1.

Figure 2B:
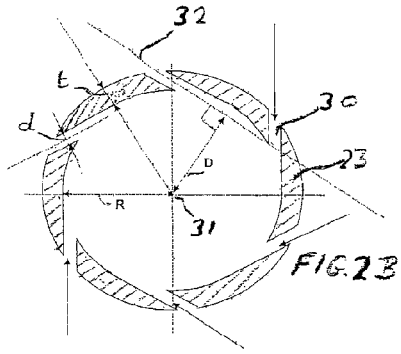
FIG. 2B depicts at an enlarged scale a cross-sectional view of the outlet channel of the throttling valve of FIG. 1A.

FIG. 2B illustrates in more detail that the tilted or non-radial perforations 30 are cylindrical and drilled in a selected partially tangential orientation relative to the central axis 31 of the fluid outlet channel 27 such that the longitudinal axis 32 of each of the perforations 30 crosses the central axis 31 at a distance D, which is between 0.2 and 1, preferably between 0.5 and 0.99, times the internal radius R of the sleeve 23.

In FIG. 2B the nominal material thickness of the perforated sleeve 23 is denoted by t and the width of the cylindrical perforations 30 is denoted by d. In an alternative embodiment of the valve according to the invention the perforations 30 may be non-cylindrical, such as square, rectangular or star-shaped, and in such case the width d of the perforations 30 is an average width defined as four times the cross-sectional area of the perforation 30 divided by the perimeter of the perforation 30. It is preferred that the ratio d/t is between 0.1 and 2, and more preferably between 0.5 and 1.

The tilted perforations 30 create a swirling flow in the fluid stream flowing through the fluid outlet channel 27 as illustrated by arrow 34. The swirling motion may also be imposed by a specific geometry of the valve trim and/or swirl guiding body 35. In the valve according to the invention the available free pressure is used for isenthalpic expansion to create a swirling flow in the fluid stream. The kinetic energy is then mainly dissipated through dampening of the vortex along an extended pipe length downstream the valve.

Figure 2C:
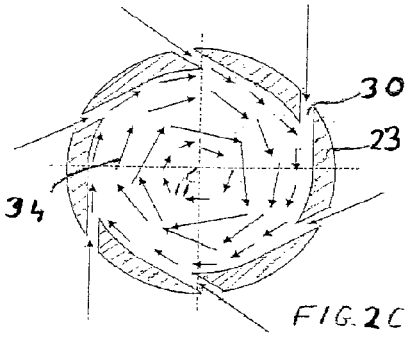
FIG. 2C illustrates the swirling motion of the fluid stream in the outlet channel of the throttling valve of FIGS. 2A and 2B.
Figure 2D:
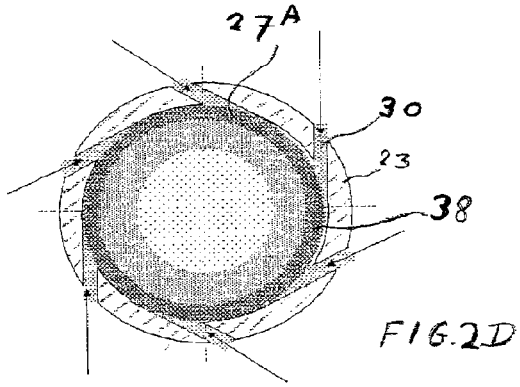
FIG. 2D illustrates the concentration of liquid droplets in the outer periphery of the outlet channel of the throttling valve of FIGS. 2A and 2B.

FIGS. 2C and 2D illustrate that the advantage of creating a swirling flow in the outlet channel of the valve is twofold:

1. Regular velocity pattern->less interfacial shear->less droplet break-up->larger drops
2. Concentration of droplets in the outer circumference 27A of the flow area of the fluid outlet channel 27->large number density->improved coalescence->larger drops 38.

Although any Joule-Thomson or other choke and/or throttling type valve may be used to create a swirling flow in the cyclonic expansion and separation device in the method according to the invention, it is preferred to use a choke-type throttling valve as supplied by Mokveld Valves B.V. and disclosed in their International patent application WO2004083691.

It will be understood that each cooling & separation method applied in NGL recovery systems, has its distinctive optimum with respect to energy efficiency. It is also noted that the near isentropic cooling methods are more energy efficient than isenthalpic methods and that from the isentropic cooling methods cyclonic expansion devices are more cost effective than turbo expander machines, albeit less energy efficient.

In accordance with the invention it has been surprisingly discovered that the combination of an isenthalpic cooling cycle (such as a mechanical refrigerator) and a near isentropic cooling method, preferably cyclonic expansion and separation devices, yields a synergy with respect to energy efficiency i.e. total duty per unit volume NGL produced. It will be understood that the different cyclonic expansion and separation devices, yield different isentropic efficiencies.

A preferred nozzle assembly of the cyclonic expansion and separation device according to the invention comprises an assembly of swirl imparting vanes arranged upstream of the nozzle, and yields an isentropic efficiency of expansion ≧80%, whereas other cyclonic expansion and separation devices with a tangential inlet section and using a counter current vortex flow (e.g. Ranque Hilsch vortex tubes) having a substantial lower isentropic efficiency of expansion <60%.

What is claimed is:

1. A method for cooling a natural gas stream and separating the cooled gas stream into various fractions having different boiling points, such as methane, ethane, propane, butane and condensates, the method comprising:

cooling the gas stream in at least one heat exchanger assembly;

separating the cooled gas stream in an inlet separation tank into a methane enriched fluid fraction and a methane depleted fluid fraction;

feeding the methane depleted fluid fraction from the inlet separation tank into a fractionating column in which a methane rich fluid fraction is separated from a methane lean fluid fraction;

feeding at least part of the methane enriched fluid fraction from the inlet separation tank into a cyclonic expansion and separation device in which said fluid fraction is expanded and thereby further cooled and separated into a methane rich substantially gaseous fluid fraction and a methane depleted substantially liquid fluid fraction, wherein the cyclonic expansion and separation device operates to recompress said methane rich substantially gaseous fluid fraction to a pressure which is substantially higher than the operating pressure of the fractionating column;

feeding the methane rich substantially gaseous fluid fraction directly from the cyclonic expansion and separation device to the at least one heat exchanger assembly to cool the incoming natural gas stream; and feeding the methane depleted substantially liquid fluid fraction from the cyclonic expansion and separation device into the fractionating column for further separation, wherein the methane rich substantially gaseous fluid fraction and feed from a top outlet conduit of the fractioning column are compressed separately in export compressors to an export pressure, wherein the cyclonic expansion and separation device comprises:

a) an assembly of swirl imparting vanes for imposing a swirling motion on the methane enriched fluid fraction, which vanes are arranged upstream of a nozzle in which the methane enriched fluid fraction is accelerated and expanded and thereby further cooled such that centrifugal forces separate the swirling fluid stream into a methane rich fluid fraction and a methane depleted fluid fraction and the cyclonic expansion and separation device further comprises an assembly of swirl imparting vanes which protrude in an at least partially radial direction from a torpedo shaped central body upstream of the nozzle, having a larger outer diameter than the inner diameter of the nozzle, or b) a throttling valve, having an outlet section which is provided with swirl imparting means that impose a swirling motion to the fluid stream flowing through the fluid outlet channel thereby inducing liquid droplets to swirl towards the outer periphery of the fluid outlet channel and to coalesce.

2. The method of claim 1, wherein the natural gas stream is cooled in a heat exchanger assembly comprising a first heat exchanger and a refrigerator such that the methane enriched fluid fraction supplied to an inlet of the cyclonic expansion and separation device has a temperature between −20 and −60 degrees Celsius, and wherein the methane rich substantially gaseous fluid fraction discharged by the cyclonic expansion and separation device is induced to pass through the first heat exchanger to cool the gas stream.

3. The method of claim 2, wherein the heat exchanger assembly further comprises a second heat exchanger in which the cooled natural gas stream discharged by the first heat exchanger is further cooled before feeding the natural gas stream to a refrigerator, and wherein cold fluid from a bottom section of the fractionating column is supplied to the second heat exchanger for cooling the natural gas stream within the second heat exchanger.

4. A system for cooling a natural gas stream and separating the cooled gas stream into various fractions having different boiling points, such as methane, ethane, propane, butane and condensates, the system comprising:

at least one heat exchanger assembly for cooling the natural gas stream;

an inlet separation tank for separating the cooled natural gas stream having an upper outlet for discharging a methane enriched fluid fraction and a lower outlet for discharging a methane depleted fluid fraction;

a fractionating column which is connected to the lower outlet of the inlet separation tank in which column at least some of the methane depleted fraction discharged from the lower outlet of the inlet separation tank is further separated into a methane rich substantially gaseous fluid fraction and a methane lean substantially liquid fluid fraction;

a cyclonic expansion and separation device which is connected to the upper outlet of the inlet separation tank, in which device said methane enriched fluid fraction is expanded and thereby further cooled and separated into a methane rich fluid fraction and a methane depleted fluid fraction, wherein the cyclonic expansion and separation device operates to recompress said methane rich substantially gaseous fluid fraction to a pressure which is substantially higher than the operating pressure of the fractionating column;

a conduit for feeding the methane rich substantially gaseous fluid fraction directly from the cyclonic expansion and separation device to the at least one heat exchanger assembly for cooling the incoming natural gas stream; and a supply conduit for feeding the methane depleted substantially liquid fluid fraction from the cyclonic expansion and separation device into the fractionating column for further separation, a first compressor for compressing the methane rich substantially gaseous fluid fraction to an export pressure; and a second compressor for compressing feed from a top outlet conduit of the fractioning column to the export pressure, wherein the cyclonic expansion and separation device comprises:

a) an assembly of swirl imparting vanes for imposing a swirling motion on the methane enriched fluid fraction, which vanes are arranged upstream of a nozzle in which the methane enriched fluid fraction is accelerated and expanded and thereby further cooled such that centrifugal forces separate the swirling fluid stream into a methane rich fluid fraction and a methane depleted fluid fraction, and the cyclonic expansion and separation device further comprises an assembly of swirl imparting vanes which protrude in an at least partially radial direction from a torpedo shaped central body upstream of the nozzle, having a larger outer diameter than the inner diameter of the nozzle, or b) a throttling valve, having an outlet section which is provided with swirl imparting means that impose a swirling motion to the fluid stream flowing through the fluid outlet channel thereby inducing liquid droplets to swirl towards the outer periphery of the fluid outlet channel and to coalesce.

5. The system of claim 4, wherein the cyclonic expansion and separation device is a throttling valve comprising a housing, a valve body which is movably arranged in the housing such that the valve body controls fluid flow from a fluid inlet channel into the fluid outlet channel of the valve further comprises a perforated sleeve via which fluid flows from the fluid inlet channel into the fluid outlet channel if in use the valve body permits fluid to flow from the fluid inlet channel into the fluid outlet channel, wherein at least some perforations of the sleeve have an at least partially tangential orientation relative to a longitudinal axis of the sleeve, such that the multiphase fluid stream is induced to swirl within the fluid outlet channel and liquid droplets are induced to swirl towards the outer periphery of the fluid outlet channel and to coalesce into enlarged liquid droplets.

6. The system of claim 5, wherein a tubular flow divider is connected to the outlet channel of the throttling valve, in which tubular flow divider liquid and gaseous phases of the fluid discharged by the valve are at least partly separated.

7. The system of claim 4, wherein the system further comprises a feed compressor and an air cooler that are arranged upstream of the at least one heat exchanger.

8. The system of claim 4, wherein the system is provided with temperature control means which are configured to maintain the temperature within an inlet of the cyclonic expansion and separation device between −20 and −60 degrees Celsius.

9. The method of claim 1, wherein the cyclonic expansion device comprises a nozzle and the isentropic efficiency of expansion in the nozzle of the cyclonic expansion device is at least 80%.

10. The system of claim 4, wherein the torpedo shaped body, the assembly of swirl imparting vanes and the nozzle are configured such that the isentropic efficiency of expansion in the nozzle is at least 80%.

11. The method of claim 2, wherein the heat exchanger assembly further comprises a second heat exchanger in which the cooled natural gas stream discharged by the first heat exchanger is further cooled before feeding the natural gas stream to the refrigerator, and wherein cold fluid from a bottom section of the fractionating column is supplied to the second heat exchanger for cooling the natural gas stream within the second heat exchanger.

12. The system of claim 4, wherein the cyclonic expansion and separation device operates to recompress said methane rich substantially gaseous fluid fraction prior to feeding said methane rich fluid fraction to an export compressor.

* * * * *